US008281544B2

(12) United States Patent
Brady

(10) Patent No.: US 8,281,544 B2
(45) Date of Patent: Oct. 9, 2012

(54) METHOD OF USING A CLIP FRAMING SYSTEM

(76) Inventor: Todd A. Brady, Beverly Hills, CA (US)

( * ) Notice: Subject to any disclaimer, the term of this patent is extended or adjusted under 35 U.S.C. 154(b) by 0 days.

(21) Appl. No.: 12/790,443

(22) Filed: May 28, 2010

(65) Prior Publication Data

US 2010/0236187 A1 Sep. 23, 2010

Related U.S. Application Data

(63) Continuation of application No. 11/393,578, filed on Mar. 29, 2006, now Pat. No. 7,730,695, which is a continuation of application No. 10/957,153, filed on Oct. 2, 2004, now Pat. No. 7,178,304, which is a continuation of application No. 10/768,284, filed on Apr. 20, 2004, now Pat. No. 6,799,408, which is a continuation of application No. 09/823,499, filed on Mar. 29, 2001, now abandoned.

(51) Int. Cl.
*E04B 1/00* (2006.01)

(52) U.S. Cl. ..... 52/745.13; 52/696; 52/702; 52/704; 52/715; 52/838; 52/745.1

(58) Field of Classification Search ..... 52/702, 52/704, 712, 715, 489.1, 696, 726.1, 713, 52/243, 241, 242, 357, 358, 359, 353, 290, 52/264, 265, 293.3, 295, 296, 297, 653.1, 52/838, 845, 848, 745.09, 745.1, 745.13
See application file for complete search history.

(56) References Cited

U.S. PATENT DOCUMENTS

| | | | | | |
|---|---|---|---|---|---|
| 1,241,281 | A | | 9/1917 | Reiss | |
| 1,981,240 | A | | 11/1934 | McNeil | |
| 2,356,309 | A | | 8/1944 | Garbe | |
| 2,387,389 | A | * | 10/1945 | Goldsmith | 52/290 |
| 2,508,032 | A | | 5/1950 | Kennedy | |
| 2,598,139 | A | | 5/1952 | Shea | |
| 3,278,043 | A | | 10/1966 | Kimpton | |
| 3,381,438 | A | | 5/1968 | Bohnsack | |
| 3,526,074 | A | | 9/1970 | Miller | |
| 3,977,149 | A | | 8/1976 | Haynes et al. | |
| 4,007,570 | A | * | 2/1977 | Hunter | 52/317 |
| 4,010,591 | A | | 3/1977 | Gross | |
| 4,018,020 | A | | 4/1977 | Sauer et al. | |
| 4,192,119 | A | | 3/1980 | Murphy | |
| 4,631,881 | A | | 12/1986 | Charman | |
| 4,905,428 | A | | 3/1990 | Sykes | |
| 5,095,678 | A | | 3/1992 | Murphy | |
| 5,157,883 | A | | 10/1992 | Meyer | |
| 5,325,651 | A | * | 7/1994 | Meyer et al. | 52/715 |
| 5,426,904 | A | | 6/1995 | Gilmore | |
| 5,442,885 | A | | 8/1995 | Laven et al. | |
| 5,464,302 | A | | 11/1995 | Menchetti | |
| 5,647,186 | A | | 7/1997 | Donaldson | |
| 5,927,041 | A | | 7/1999 | Sedlmeier et al. | |
| 6,295,764 | B1 | | 10/2001 | Berridge et al. | |
| 6,519,911 | B1 | | 2/2003 | Sawada | |
| 6,820,388 | B2 | | 11/2004 | Newhouse et al. | |
| 7,178,305 | B2 | | 2/2007 | Petrova | |

* cited by examiner

*Primary Examiner* — William Gilbert
(74) *Attorney, Agent, or Firm* — Trojan Law Offices

(57) ABSTRACT

A method of using a framing system for adjustably connecting building components comprising an outer stud, an interior support member, and a connecting clip.

3 Claims, 7 Drawing Sheets

METHOD OF USING A CLIP FRAMING SYSTEM

STATEMENT OF PRIORITY

This is a continuation application Ser. No. 11/393,578, filed Mar. 29, 2006, now U.S. Pat. No. 7,730,695, which is a continuation of Ser. No. 10/957,153, filed Oct. 2, 2004, now U.S. Pat. No. 7,178,304 B2, which is a continuation application of Ser. No. 10/768,284, filed Apr. 20, 2004, now U.S. Pat. No. 6,799,408 B2, which is a continuation application of Ser. No. 09/823,499, filed Mar. 29, 2001, now abandoned.

BACKGROUND OF THE INVENTION

1. Field of the Invention

This invention relates to a building construction assembly, which provides a framing system for adjustably connecting building components and for strengthening structural wall components. By allowing for adjustable connection of these building components, the user will realize significant cost savings from using less labor and material for the same construction needs.

2. Description of Related Art

Prior to the present invention, walls were constructed with vertical studs secured to horizontal headers. When there was a need for an opening in a wall, such as the case with a door or windows, then considerable time, energy, and resources were devoted to creating the window or door opening to avoid the opening in the wall from compromising the structural integrity of the wall. For example, each window requires its own header running along the top edge of the window. The ends of the window header must be secured to adjacent vertical studs on each side of the window. In commercial construction, the window headers had to be secured to the studs with plates, straps, or brackets, which needed to be bolted and/or welded to both the horizontal and vertical pieces. In addition, brackets were formed when the ends of studs were cut and bent back in a "dog-eared" or "dovetailed" fashion. This extra work to cut, bolt, and weld these brackets added considerably to the construction time and the workload. In addition, the construction codes governing many commercial and public buildings require that studs be re-enforced at critical load points in the building by strapping, bracketing, and/or welding together multiple vertical studs. In many cases, the straps and/or brackets themselves must be welded to the studs to meet the government code requirements. Welding together multiple studs to increase the structural integrity of the wall is an extremely labor and material intensive activity that significantly adds to the cost of construction. The need for re-enforcing headers over door and window openings sometimes requires that multiple stud pieces and tracks be welded, bracketed, and/or strapped together in similar fashion to form the proper header. Further, the studs and tracks normally arrived at the construction site in oversize lengths, and the studs were usually cut to fit at the job site. Having to spend time and labor to cut these lengths to custom fit the particular application also increased construction costs.

As the result of the extra welding and strapping required by the re-enforcing of headers and studs, cosmetic problems were created because the above straps, welds, brackets, and plates connecting the studs and headers rose above the planar surface of the wall, which would create bulges in the wall board. To correct for this problem, additional labor and material was needed to tape and to plaster over these indentations on the surface of the wall. Hence, the prior art method was definitely in need of improvement.

The claimed invention avoids the above problems and provides a significant savings in material and labor costs. To provide similar or even improved structural support, less material is used in the claimed invention; for example, one framing clip system with its internal support member can replace up to 4 or 5 pieces of welded studs. In addition, valuable time and labor would not be wasted in welding and/or fastening these studs together. At the corner of frames, the claimed invention also avoids having to use large brackets, straps, or plates to connect a horizontal header to the vertical studs. By not having these brackets and plates jut out of the wall surface, labor and materials would not be needed to hide these wall imperfections. Further, because this invention allows for fine adjustment due to the frictional connection between the components of the invention, the users of this invention can have the studs and building pieces prefabricated and cut to the custom specifications of the project at the factory. As a result, instead of having to measure and cut the building studs at the work site, the user will simply make fine adjustments during assembly with the prefabricated pieces.

From the preceding descriptions, it is apparent that the devices currently being used have significant disadvantages. Thus, important aspects of the technology used in the field of invention remain amenable to useful refinement.

SUMMARY OF THE INVENTION

The purpose of the present invention is to provide a framing system for adjustably connecting building components for a building construction. This framing system employs an outer stud, which is frictionally and adjustably connected with a connecting clip, and an interior support member.

Another purpose of the present invention is to provide a sufficient and easy way to connect horizontal building pieces with vertical pieces in constructing wall openings, such as doorways and window openings.

Another purpose of the present invention is a way to streamline the construction process by allowing adjustability of the building parts during construction.

Still a further purpose of the present invention is to reduce the time, labor, and materials used in strengthening and constructing walls in buildings.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

DESCRIPTION OF THE PREFERRED EMBODIMENTS

Figures 1, 3:
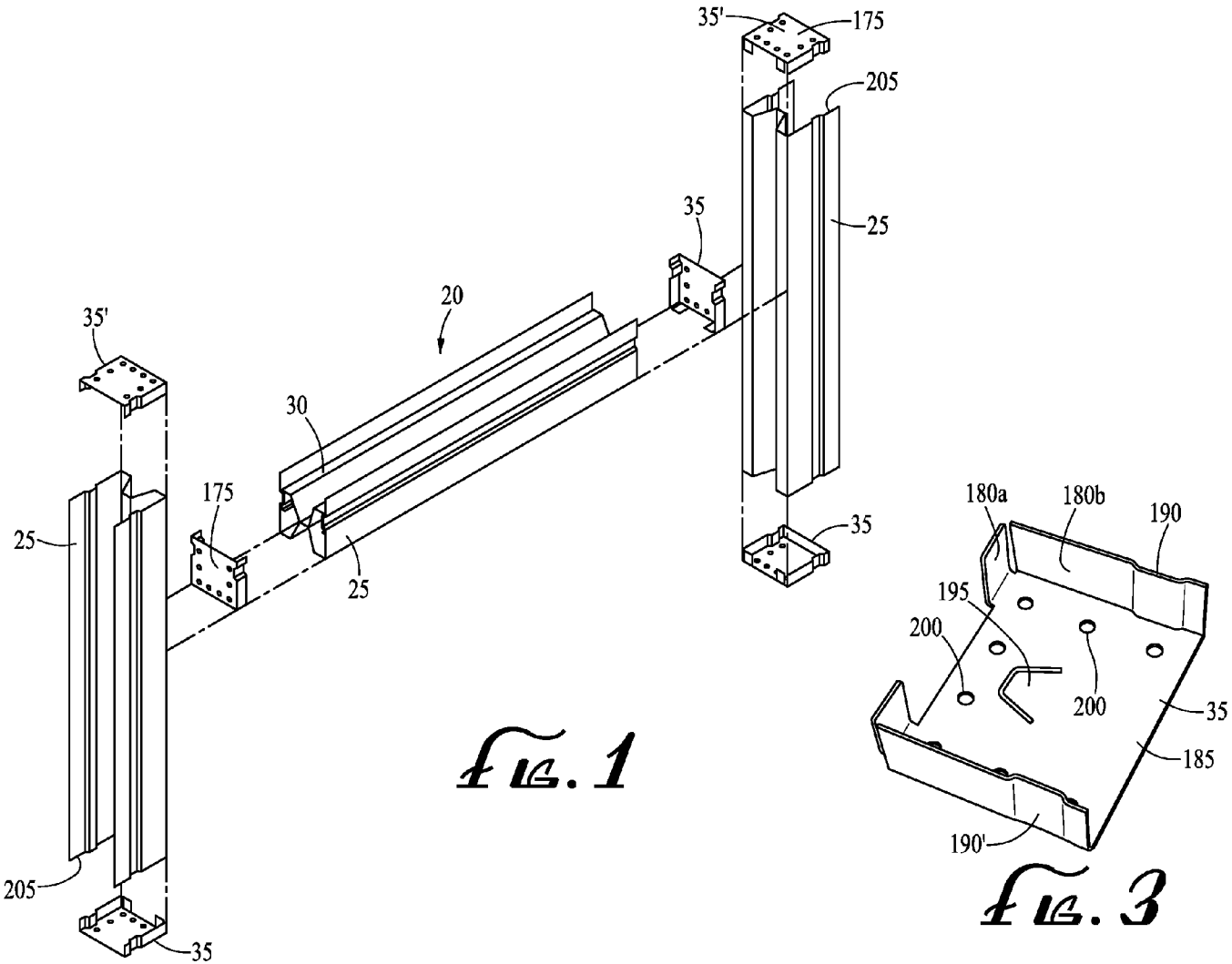
FIG. 1 is an exploded view of the framing system in a vertical and horizontal position.
FIG. 3 is a view of the connecting clip.
Figure 2:
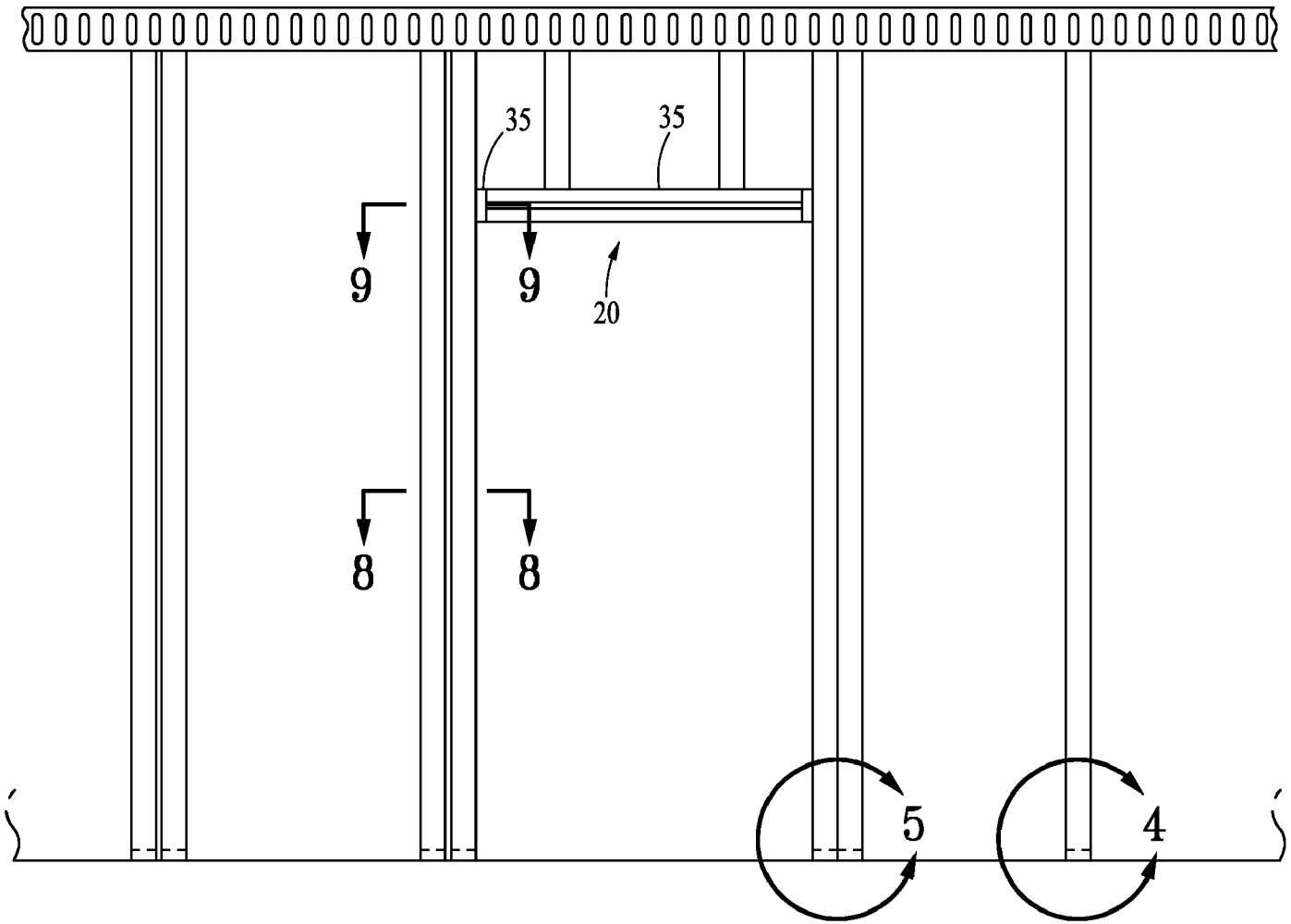
FIG. 2 is a side view of the framing system when assembled for the frame of a door, window, or wall opening.

Referring to FIGS. 1 and 2, there is illustrated a framing system 20 for adjustably connecting building components for the construction of buildings and structures and comprises an outer stud 25, an interior support member 30, and a connecting clip 35.

Configuration of the Outer Stud

Figure 4:
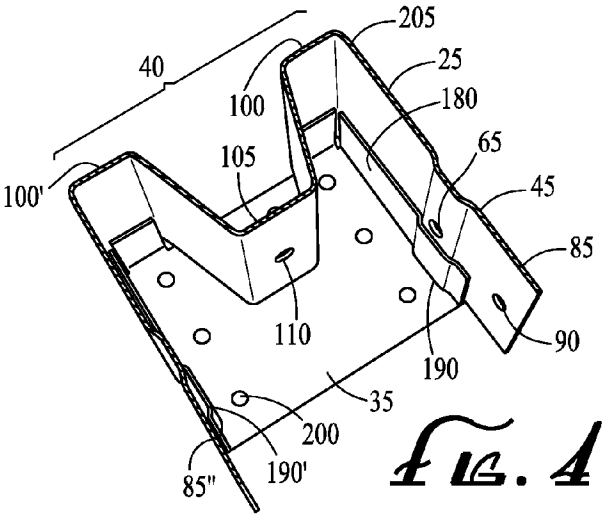
FIG. 4 is a sectional view of the connecting clip removably connected to the outer stud as shown in FIG. 2.
Figure 5:
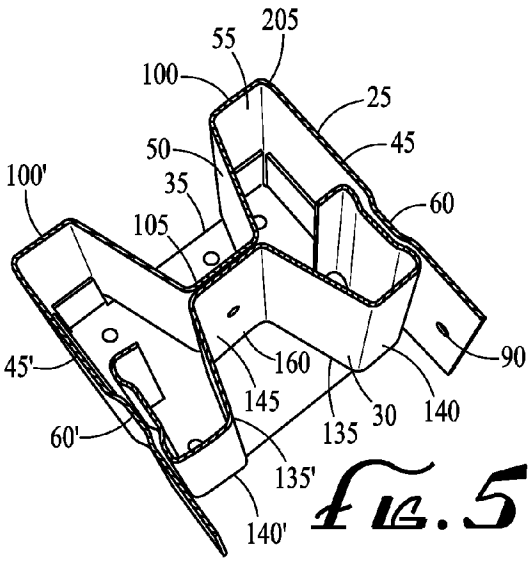
FIG. 5 is a sectional view of the framing system with the connecting clip, the interior support member, and the outer stud as shown in FIG. 2.
Figure 6:
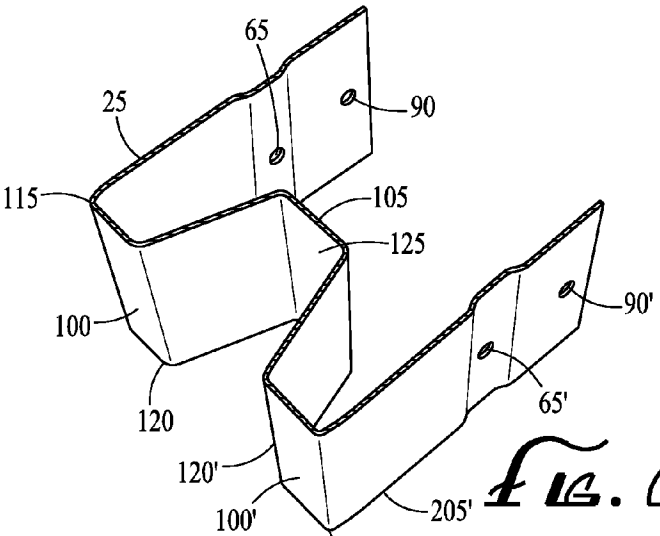
FIG. 6 is a sectional view of the outer stud in FIG. 2.

In FIGS. 4-6, the outer stud 25 has a web 40 from which two flanges 45, 45' extend perpendicularly. This web 40 also has an outer web surface 50 and an inner web surface 55. Each of said flanges 45, 45' includes receptors 60, 60', which are substantially opposite of each other and engage said interior support member 30. In the preferred embodiment, the receptors 60, 60' are curved slightly inward and concave to the surface of the flanges, but can be any configuration that serves the function of a receptor. The receptors 60, 60' also can have holes 65, 65' for attachment devices 75, such as self-tapping screws or bolts, for securing the inner surface 75 of the interior support member 30 to the outer stud 25. The interior support member also has an outer surface 80. The flanges 45, 45' of the outer stud 25 have peripheral ends 85, 85', which also can have holes 90, 90' for attachment devices 70, such as self-tapping screws or bolts, for securing the outer stud 25 to another structure 95 of the building, another stud, or another framing system. The web 40 of the outer stud 25 has at least a first elevation 100 and a second elevation 105.

Figure 8:
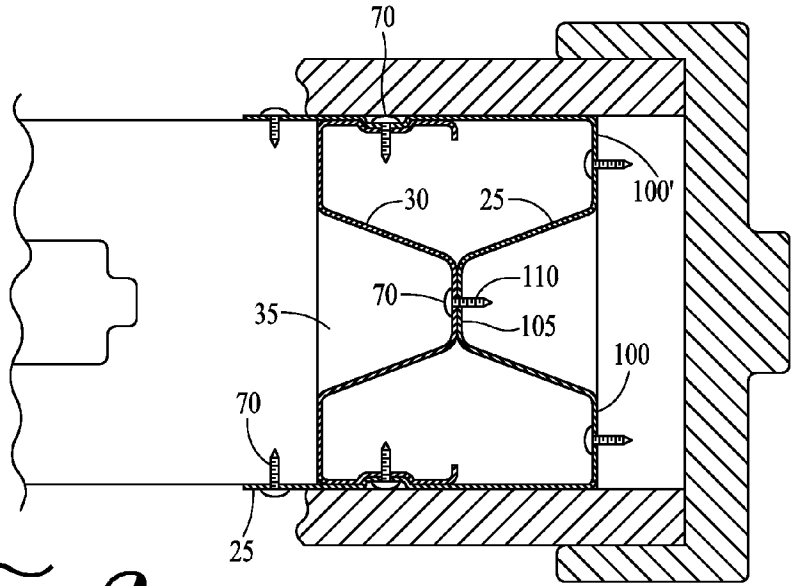
FIG. 8 is sectional view of the framing clip in connection with another framing clip in FIG. 2.
Figure 9:
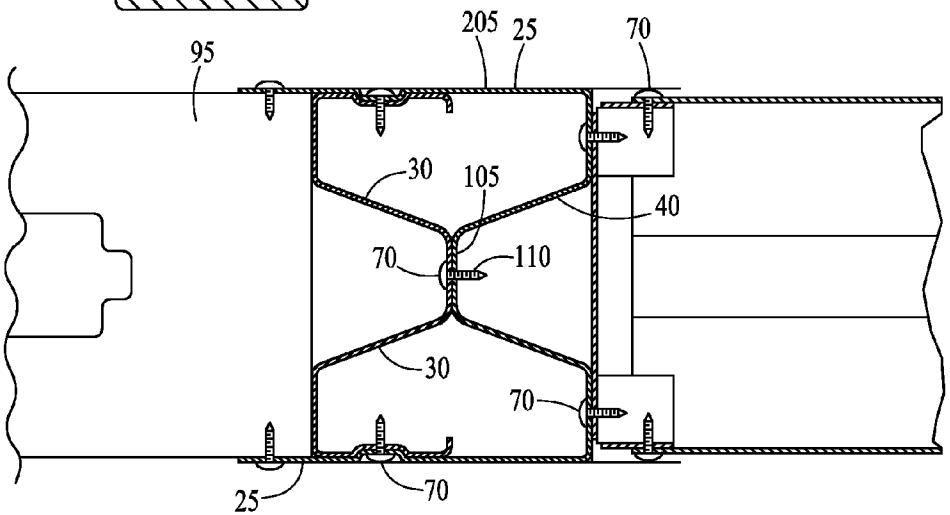
FIG. 9 is a sectional view of a framing clip in FIG. 2.

In the embodiment shown in FIGS. 4-6, the web 40 has at least a first elevation 100, 100' and a second elevation 105. The first and second elevations 100, 105 are shown in the preferred embodiment as perpendicular to the flanges 45, 45', and the second elevation 105 is parallel to the first elevation 100. As shown in FIGS. 8 and 9, the second elevation 105 also can have a hole 110 that allows an attachment device 70, such as a self-tapping screw or a bolt, to connect the outer stud 25 with the connecting clip 35 and/or the internal support member 30. The second elevation 105 of the web 40 is located between the flanges 45, 45'.

In the embodiment, as shown in FIGS. 4-6, the first elevation 100 has a first edge 115 and a second edge 120. From the first edge 100, the web slants towards the second elevation 105 to form a second elevation surface 125. Then, the web 40 continues from the second elevation surface 125 towards the adjacent next first elevation 100'. The outer stud 25 also has a terminal end 205. This terminal end 205 will contact the connecting clip during assembly.

Inner Support Member

Figure 7:
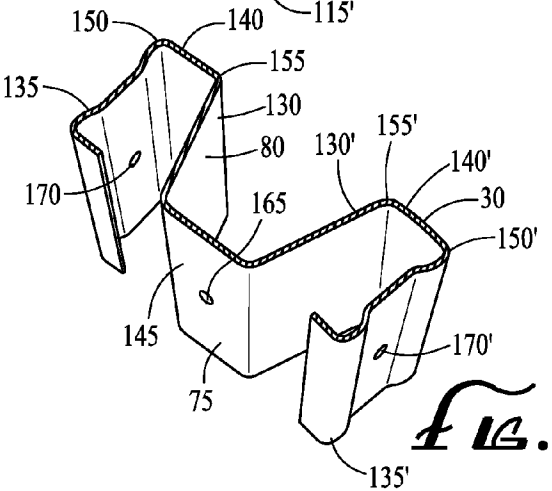
FIG. 7 is a sectional view of the interior support member in FIG. 2.

In FIGS. 5-7, the interior support member 30 has an inner surface 75 that is substantially perpendicular to the flanges 45, 45'. The interior support member 30 also has an outer surface 80. The inner surface 75 has bracing arms 130, 130' extending therefrom toward said flanges 45, 45' of the outer stud. The bracing arms 130, 130' have extensions 135, 135' for engaging said receptors 60, 60' of the outer stud's flanges 45, 45' with the interior support member 30. In the embodiment shown in FIGS. 5 and 7, the interior support member has at least a third elevation 140, 140' and a fourth elevation 145. The third 140 and fourth 145 elevations are substantially parallel to one another in the preferred embodiment, but the third elevation 140 exists on a different horizontal plane in relation to the fourth elevation 145. The third elevation 140 has a third edge 150, 150' and a fourth edge 155, 155'. From the third edge 150 to the fourth edge 155, the inner surface 75 slants towards the fourth elevation 145 to form a surface 160. Then, the inner surface 75 continues from the fourth elevation surface 160 towards the adjacent third elevation 140'.

The fourth elevation 145 is located between the bracing arms 130, 130' and can have a hole 165 for an attachment device 70 to secure said inner surface 75 and the second elevation 105 together. When assembled with the outer stud 25, the interior support member 30 is substantially flush with said second elevation 105. An attachment device 70, such as a self-tapping screw or bolt, secures said inner surface 75 and said second elevation 105 together. The extensions 135, 135' of the interior support member 30 can also have holes 170, 170' for an attachment device 70, such as a self-tapping screw or a bolt, to further secure said internal support member 30 and said outer stud 25 together. FIG. 5 shows how the inner support member 30 fits inside the sides 180 of the connecting clip 35.

Figure 11:
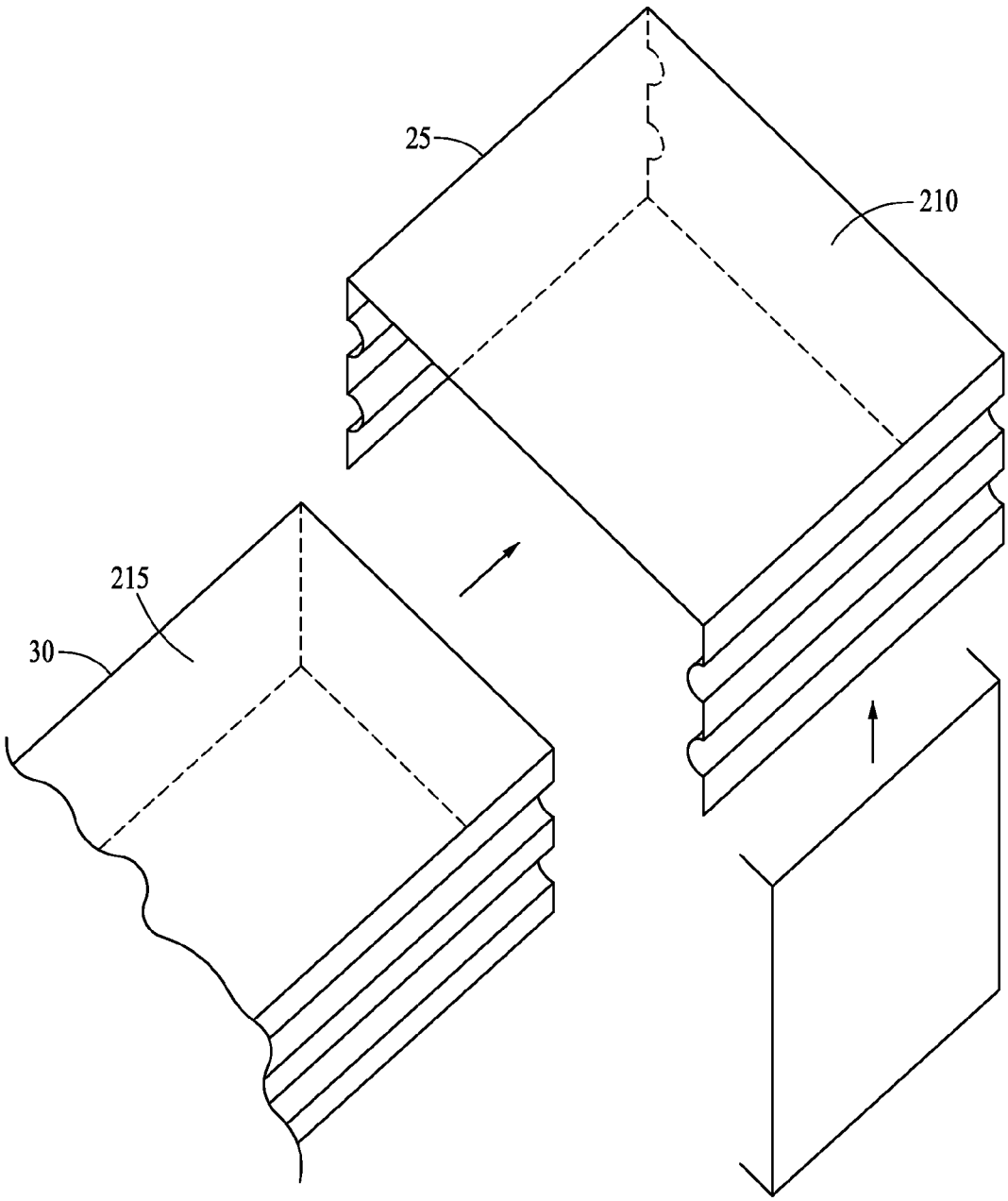
FIG. 11 is a perspective view of the second embodiment.
Figure 12:
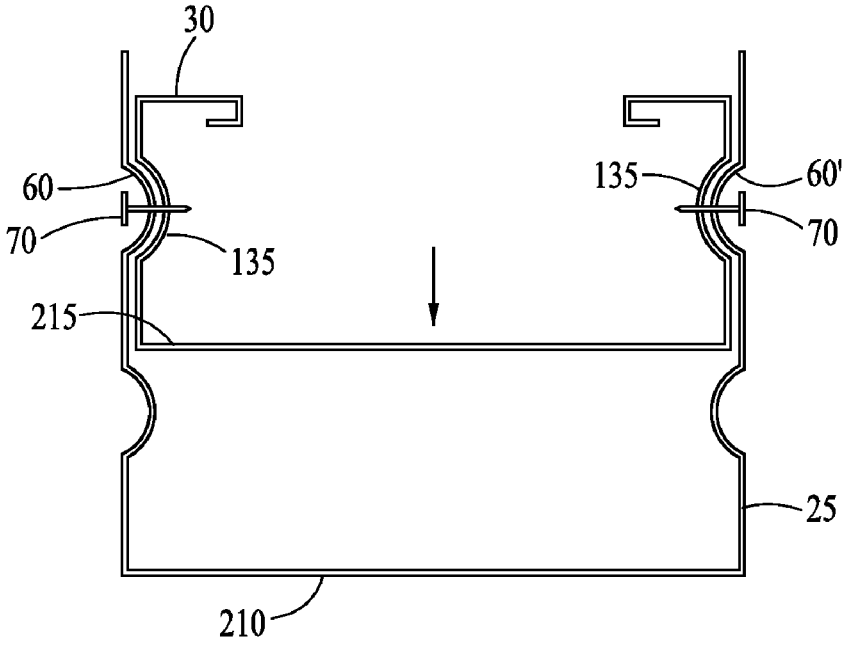
FIG. 12 is a terminal end view of the second embodiment.

In FIGS. 11 and 12, a second embodiment is shown in which outer stud 25 has a web 210 that has a single elevation. In this second embodiment, the inner support member has a web 215 that is preferred to be of a single elevation. Otherwise, the second embodiment functions substantially the same as the first embodiment with receptors 60, 60' engaging the extensions 135 of the inner support member 30.

Figure 13:
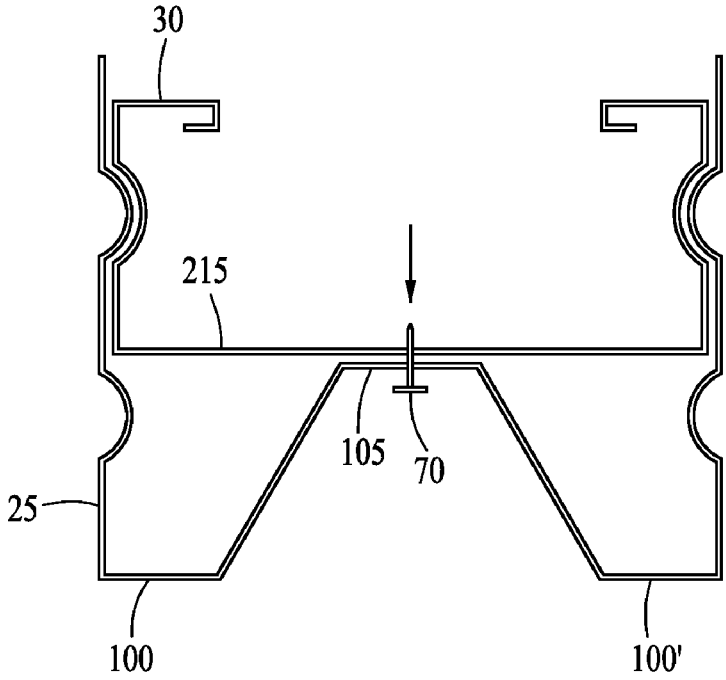
FIG. 13 is a terminal end view of the third embodiment.

In FIG. 13, there is depicted a third embodiment illustrating a hybrid of the first and second embodiments wherein the web has two elevations 100 and 105 wherein the second elevation 105 is secured to a single elevation 215 of the interior support member 30. The single elevation 215 of interior support member 30 can be secured to the outer stud 25 with an attachment device 70 such as a screw or a bolt.

Connecting Clip

Figure 10:
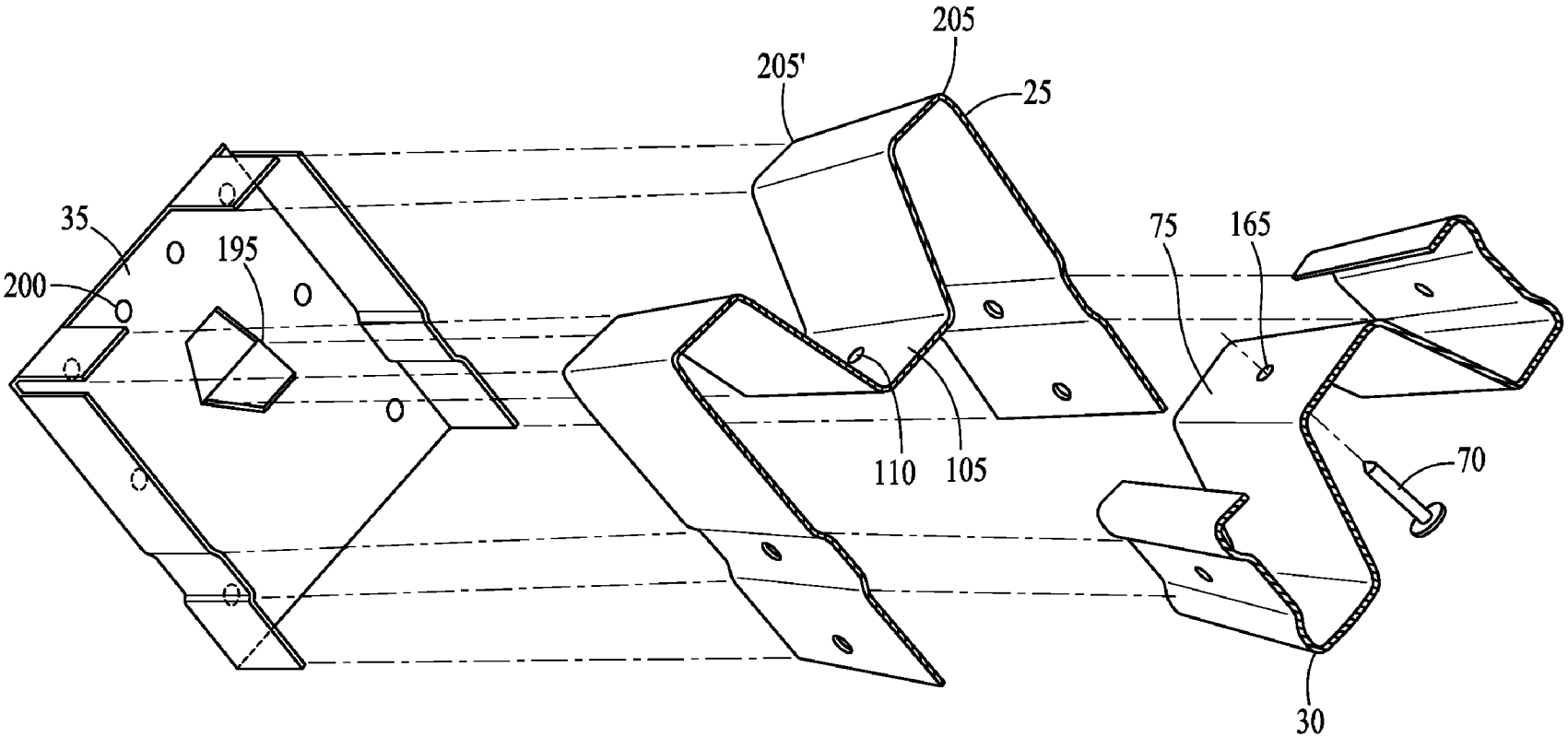
FIG. 10 is a perspective and exploded view of the framing clip engaging the end of the stud.

In FIGS. 3-5, the connecting clip 35 has an outer contact surface 175 and sides 180. The connecting clip also has an inner contact surface 185 and elevation sides 180*a* and flange sides 180*b*. The flange sides 180 also have indentations 190, 190' that correspond to the receptors 60, 60' on the outer stud's flanges 45, 45'. As shown in FIGS. 3-5, these indentations 190, 190' are concave to the outer contact surface 175. The connecting clip 35 has a tab 195, which can be bent from the outer contact surface 175 of the connecting clip 35 and can extend therefrom between said flanges 45, 45'. This tab 195 is substantially flush with the outer stud's second elevation 105. An attachment device 70, such as a self-tapping screw or a bolt, can secure said tab 195 and said second elevation 105 together as shown in FIG. 10. The connecting clip 35 can be used with any of the three embodiments shown in the drawings.

The outer contact surface 175 of the connecting clip 35 can have a multitude of holes 200 wherein said connecting clip 35 secures to a building or secures to another assembly perpendicularly as shown in FIG. 9. The connecting clip 35 frictionally engages the terminal end 205 of the outer stud 25. FIG. 4 shows how the sides 180 of the connecting clip 35 are overlapped by the flanges 45, 45' of the outer stud 25.

The framing assembly's outer stud 25 and interior support member 30 may be in the shape of a "W," but it will be apparent that the invention is not limited by the shape of the outer stud and interior support member. The outer stud, interior support member and connecting clip can be constructed or any metal or metallic building compound. The width of the web 40 of the outer stud 25 is slightly greater than the width of the flange sides 180*b* of the connecting clip 35 so that the sides 180 of the connecting clip 35 can fit within the web 40 of the outer stud 25 but over the extensions 135, 135' of the interior support member 30.

Method of Assembly

The claimed invention can be used in a variety of horizontal or vertical building applications.

Horizontal Assembly:

As shown in FIGS. 1, 2, and 9, the user places a connecting clip 35 at each terminal end 205, 205' of an outer stud 25. Because the connecting clip 35 frictionally engages the terminal end 205, 205' of the outer stud 25, the invention affords fine adjustment of the length of the outer stud 25 before the connecting clips 35 are secured with an attachment device 70, such as a nail, screw, or bolt, to an adjoining building structure 95 or another framing assembly 20. Because the connecting clip 35 rests substantially flush against a perpendicular outer stud 25' or adjoining building structure, the horizontal outer stud 25 and connecting clip 35 can be securely connected with attachment devices 70, and the invention avoids the need for separate plates or brackets or cutting the ends of the studs to connect the vertical stud pieces to the horizontal stud pieces. Since the horizontal studs and the vertical studs form a smooth surface, no finishing plaster work will need to be done in completing the construction project. For heavier duty projects, the internal support member 30 can be used with the connecting clips 35 and the outer studs 25.

Vertical Application:

For vertical applications, as shown in FIGS. 1, 2, 4, 5, and 8, instead of being placed horizontally, the connecting clip 35 will be securely fastened to the floor of the building and will hold the outer stud 25. The user will frictionally engage the terminal end 205 of the outer stud 25 on the inner contact surface 180 of the connecting clip 35. At the other end of the outer stud 25, a second connecting clip 35' can be placed. Because the connecting clip 35' frictionally engages the outer stud 25, there is a level of vertical adjustment possible by sliding the outer stud 25 with the connecting clip 35' before the connecting clip 35' is securely fastened to the building structure.

To provide a stronger building structure, the interior support member 30 can be used in both the horizontal or vertical application. Further, the basic framing system of an outer stud and an interior support member with the connecting clips or the terminal caps at each end of the outer stud can be combined with other framing systems to increase the strength of the building components. Multiple framing systems can be simply attached to each other with attachment devices such as self-tapping screws or bolts at the proximal ends of the flanges. Also, with the use of other metal parts, such as a metal bar or a post, different combination of parts can be assembled.

While the invention as described in connection with its preferred embodiments, it will be understood that it is not intended to limit the invention to those embodiments. On the contrary, it is intended to cover all alternatives, modifications, and equivalents as may be included within the spirit and scope of the invention as defined by the appended claims.

I claim:

1. A method for adjustably assembling a framing system comprising the steps of:

connecting a first clip to at least one terminal end of a first member, said first clip having a contact plate with two flanges and two elevation sides, said first member having two flanges connected by a web that form a substantially M-shaped cross-section, said first clip connected to said terminal end of said first member by slideably engaging said terminal end of said first member into said first clip such that said elevation sides of said first clip engage said web of said first member, and said flanges of said first clip engage said flanges of said first member;

connecting a second clip that is identical to said first clip to at least one terminal end of a second member that is identical to said first member by the same method that said first clip is connected to said first member;

connecting a third clip that is identical to said first clip to a first terminal end of a third member that is identical to said first member by the same method that said first clip is connected to said first member;

connecting a fourth clip that is identical to said first clip to a second terminal end of said third member;

securing said third clip to said first member;

securing said fourth clip to said second member;

wherein said third member is adjustably connected to said first member and said second member.

2. A method for assembling a framing system according to claim 1 further comprising the steps of:

assembling an interior support member to between said third clip and said fourth clip, such that said interior support member is adjacent to said horizontal member.

3. A method for adjustably assembling a framing system comprising the steps of:

connecting a first clip to first end of a first member, said first clip having a contact plate with two flanges and two elevation sides, said first member having two flanges connected by a web, said web disposed between said two flanges and said web forming acute angles with each said flange, said first clip connected to said terminal end of said first member by slideably engaging said terminal end of said first member into said first clip such that said elevation sides of said first clip engage said web of said first member, and said flanges of said first clip engage said flanges of said first member;

connecting a second clip that is identical to said first clip to a second terminal end of said first member in the same manner that said first clip is connected to said first terminal end;

securing said first clip to a second member, said second member being identical to said first member;

securing said second clip to a third member, said third member being identical to said first member;

wherein said first member is adjustably connected between said second member and said third member.

* * * * *